US010255870B2

(12) United States Patent
Wang

(10) Patent No.: US 10,255,870 B2
(45) Date of Patent: Apr. 9, 2019

(54) DISPLAY DRIVING CIRCUIT, ITS CONTROL METHOD AND DISPLAY DEVICE

(71) Applicants: BOE TECHNOLOGY GROUP CO., LTD., Beijing (CN); BEIJING BOE DISPLAY TECHNOLOGY CO., LTD., Beijing (CN)

(72) Inventor: Zheng Wang, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/652,474

(22) Filed: Jul. 18, 2017

(65) Prior Publication Data

US 2018/0025687 A1 Jan. 25, 2018

(30) Foreign Application Priority Data

Jul. 19, 2016 (CN) ..... 2016 1 0571242

(51) Int. Cl.
*G09G 3/36* (2006.01)
*G09G 3/3266* (2016.01)

(52) U.S. Cl.
CPC ..... *G09G 3/3677* (2013.01); *G09G 3/3266* (2013.01); *G09G 3/3696* (2013.01); *G09G 2300/0408* (2013.01); *G09G 2310/0267* (2013.01); *G09G 2310/0286* (2013.01); *G09G 2310/08* (2013.01); *G09G 2330/08* (2013.01)

(58) Field of Classification Search
CPC ..... G09G 3/2092; G09G 3/3677; G09G 2300/0408; G09G 2310/0286; G09G 2330/08; G09G 2310/08; G09G 2310/0267; G09G 2300/08; G09G 2330/02; G09G 3/3266; G09G 3/3674–3/3681; G09G 3/3696
See application file for complete search history.

(56) References Cited

U.S. PATENT DOCUMENTS 9,257,099 B2 * 2/2016 Koo ..... G09G 5/20
2014/0049528 A1 * 2/2014 Koo ..... G09G 5/20 345/208

(Continued)

*Primary Examiner* — Patrick F Marinelli
(74) *Attorney, Agent, or Firm* — Brooks Kushman P.C.

(57) ABSTRACT

The display driving circuit according to an embodiment of the present disclosure includes a characteristic collector, a comparator, a timing controller and a gate driver. The gate driver includes shift register units each including a first pull-down circuit and a second pull-down circuit, and is provided with a first pull-up voltage terminal and a second pull-up voltage terminal; the characteristic collector is configured for collecting a voltage of the first pull-up voltage terminal or the second pull-up voltage terminal, and for outputting a characteristic voltage; the comparator is configured for comparing the characteristic voltage with a reference voltage of a reference voltage terminal; when the comparison result indicates that the characteristic voltage is greater than or equal to the reference voltage, the timing controller generates a timing control signal such that the first pull-up voltage terminal and the second pull-up voltage terminal are caused to output a DC voltage under the control of the timing control signal.

20 Claims, 6 Drawing Sheets

(56) References Cited

U.S. PATENT DOCUMENTS

| | | | | |
|---|---|---|---|---|
| 2016/0260405 | A1* | 9/2016 | Dai | G09G 3/3677 |
| 2016/0275895 | A1* | 9/2016 | Dai | G09G 3/36 |
| 2017/0301305 | A1* | 10/2017 | Gao | G09G 3/3677 |
| 2018/0025687 | A1* | 1/2018 | Wang | G09G 3/2092 345/213 |
| 2018/0174545 | A1* | 6/2018 | Li | G09G 3/3648 |
| 2018/0197496 | A1* | 7/2018 | Gao | G09G 3/3677 |
| 2018/0197497 | A1* | 7/2018 | Shao | G09G 3/3677 |

* cited by examiner

DISPLAY DRIVING CIRCUIT, ITS CONTROL METHOD AND DISPLAY DEVICE

CROSS-REFERENCE TO RELATED APPLICATION

The present application claims a priority of the Chinese patent application No. 201610571242.5 filed on Jul. 19, 2016, which is incorporated herein by reference in its entirety.

TECHNICAL FIELD

The present disclosure relates to the field of display technology, in particular to a display driving circuit, its control method and a display device.

BACKGROUND

A TFT-LCD (Thin Film Transistor Liquid Crystal Display) or an OLED (Organic Light Emitting Diode) display is provided with an array substrate, wherein the array substrate can be divided into a display region and a wiring region located at the periphery of the display region. The peripheral region is provided with a gate driver configured for progressively scanning gate lines. The existing gate drivers usually adopt a GOA (Gate Driver on Array) design in which a TFT (Thin Film Transistor) gate switching circuit is integrated in the peripheral region to constitute a GOA circuit, thereby achieving a narrow frame design.

The GOA circuit includes a plurality of cascade shift register units, and an output terminal of each of the cascade shift register units is connected to a row of gate lines. During progressive scanning of the gate lines by the GOA circuit, a signal output terminal OUTPUT(n) of a certain level shift register unit RSn outputs a gate scanning signal to a gate line Gn so as to complete the scanning of the gate line Gn. When a signal output terminal OUTPUT (n+1) of a next level shift register unit RS(n+1) outputs a gate scanning signal, a potential of the signal output terminal OUTPUT (n) of the previous level shift register unit RSn needs to be pulled down to a low level, thereby ensuring that no scanning signal is outputted from the signal output terminal OUTPUT (n).

When only one pull-down circuit is provided in the shift register unit, the pull-down circuit is required to be in a working state during the non-output phase of the shift register unit, thereby causing the TFT in the pull-down circuit to be in an ON state for a long period of time. As a result, the characteristics of the TFT are attenuated and the lifetime of the GOA circuit is reduced. In order to solve this problem, a plurality of alternately operated pull-down circuits is usually provided in one shift register unit in the related art. However, if one of the plurality of the alternately operated pull-down circuits is damaged, the GOA circuit will not be able to work properly.

SUMMARY

An object of the present disclosure is to provide a display driving circuit, its control method and a display device, so as to solve the problem that the GOA circuit will not be able to work properly when one of the plurality of the alternately operated pull-down circuits in the shift register unit is damaged.

To achieve this object, the present disclosure provides in embodiments the following technical solutions.

In one aspect, the present disclosure provides a display driving circuit, comprising a characteristic collector, a comparator, a timing controller and a gate driver; wherein the gate driver comprises at least two cascade shift register units, the shift register unit comprising a first pull-down circuit connected to a first pull-down node and a second pull-down circuit connected to a second pull-down node; and the gate driver is provided with a first pull-up voltage terminal for charging the first pull-down node and a second pull-up voltage terminal for charging the second pull-down node; wherein the characteristic collector is connected to a pull-down voltage terminal and a first input terminal of the comparator, and also to the first pull-up voltage terminal or the second pull-up voltage terminal; the characteristic collector is configured for collecting a voltage of the first pull-up voltage terminal or the second pull-up voltage terminal, and for outputting, to the first input terminal of the comparator, a characteristic voltage which conforms to characteristics of the voltage of the first pull-down circuit or the second pull-down circuit; wherein a second input terminal of the comparator is connected to a reference voltage terminal, and an output terminal of the comparator is connected to the timing controller; and the comparator is configured for comparing the characteristic voltage with a reference voltage of the reference voltage terminal; and wherein the timing controller is further connected to the gate driver; and the timing controller is configured for receiving a comparison result from the comparator, and when the comparison result indicates that the characteristic voltage is greater than or equal to the reference voltage, the timing controller generates a timing control signal such that the first pull-up voltage terminal and the second pull-up voltage terminal are caused to output a DC voltage under the control of the timing control signal, thereby causing the first pull-down node and the second pull-down node to be simultaneously charged, and both the first pull-down circuit and the second pull-down circuit to be in a working state.

In an optional embodiment, the characteristic collector comprises a first collection transistor and a second collection transistor; a second electrode of the first collection transistor is connected to a first electrode of the second collection transistor; the first electrode of the second collection transistor is connected to the pull-down voltage terminal; and a second electrode of the second collection transistor is connected to the first input terminal of the comparator; and a gate electrode and a first electrode of the first collection transistor are connected to the first pull-up voltage terminal, and a gate electrode of the second collection transistor is connected to the first pull-up voltage terminal; or the gate electrode and the first electrode of the first collection transistor are connected to the second pull-up voltage terminal, and the gate electrode of the second collection transistor is connected to the second pull-up voltage terminal.

In an optional embodiment, the shift register unit further comprises a pull-up control circuit, a pull-up circuit, a reset circuit, a first pull-down control circuit and a second pull-down control circuit; the pull-up control circuit is connected to a signal input terminal and a pull-up node, and configured for outputting a voltage of the signal input terminal to the pull-up node under the control of the signal input terminal; the pull-up circuit is connected to a first clock signal input terminal, the pull-up node and a signal output terminal, and configured for outputting a signal of the first clock signal input terminal to the signal output terminal under the control of the pull-up node; the reset circuit is connected to a reset signal terminal, the pull-down voltage terminal, the pull-up node and the signal output terminal, and configured for respectively pulling down a potential of the pull-up node and of the signal output terminal to a potential of the pull-down voltage terminal under the control of the reset signal terminal; the first pull-down control circuit is connected to the first pull-up voltage terminal, a second clock signal input terminal, the reset signal terminal, the pull-up node, the first pull-down node and the pull-down voltage terminal, and configured for outputting a voltage of the first pull-up voltage terminal to the first pull-down node under the control of the second clock signal input terminal and the reset signal terminal, or for pulling down a potential of the first pull-down node to the potential of the pull-down voltage terminal under the control of the pull-up node; the second pull-down control circuit is connected to the second pull-up voltage terminal, the second clock signal input terminal, the reset signal terminal, the pull-up node, the second pull-down node and the pull-down voltage terminal, and configured for outputting a voltage of the second pull-up voltage terminal to the second pull-down node under the control of the second clock signal input terminal and the reset signal terminal, or for pulling down a potential of the second pull-down node to the potential of the pull-down voltage terminal under the control of the pull-up node; the first pull-down circuit is further connected to the pull-up node, the signal output terminal and the pull-down voltage terminal, and configured for respectively pulling down a potential of the pull-up node and of the signal output terminal to the potential of the pull-down voltage terminal under the control of the first pull-down node; and the second pull-down circuit is further connected to the pull-up node, the signal output terminal and the pull-down voltage terminal, and configured for respectively pulling down the potential of the pull-up node and of the signal output terminal to the potential of the pull-down voltage terminal under the control of the second pull-down node.

In an optional embodiment, the pull-up control circuit includes a first transistor, and a gate electrode and a first electrode of the first transistor are connected to the signal input terminal, and a second electrode of the first transistor is connected to the pull-up node.

In an optional embodiment, the pull-up circuit includes a second transistor and a first capacitor; a gate electrode of the second transistor is connected to the pull-up node, a first electrode of the second transistor is connected to the first clock signal input terminal and a second electrode of the second transistor is connected to the signal output terminal; and a first end of the first capacitor is connected to the pull-up node and a second end of the first capacitor is connected to the signal output terminal.

In an optional embodiment, the reset circuit includes a third transistor and a fourth transistor; a gate electrode of the third transistor is connected to the reset signal terminal, a first electrode of the third transistor is connected to the pull-down voltage terminal, and a second electrode of the third transistor is connected to the pull-up node; and a gate electrode of the fourth transistor is connected to the reset signal terminal, a first electrode of the fourth transistor is connected to the pull-down voltage terminal, and a second electrode of the fourth transistor is connected to the signal output terminal.

In an optional embodiment, the first pull-down control circuit includes a fifth transistor, a sixth transistor, and a seventh transistor; a gate electrode of the fifth transistor is connected to the second clock signal input terminal, a first electrode of the fifth transistor is connected to the first pull-up voltage terminal and a second electrode of the fifth transistor is connected to the first pull-down node; a gate electrode of the sixth transistor is connected to the reset signal terminal, a first electrode of the sixth transistor is connected to the first pull-up voltage terminal and a second electrode of the sixth transistor is connected to the first pull-down node; and a gate electrode of the seventh transistor is connected to the pull-up node, a first electrode of the seventh transistor is connected to the pull-down voltage terminal, and the second electrode of the seventh transistor is connected to the first pull-down node.

In an optional embodiment, the second pull-down control circuit includes an eighth transistor, a ninth transistor, and a tenth transistor; a gate electrode of the eighth transistor is connected to the reset signal terminal, a first electrode of the eighth transistor is connected to the second pull-up voltage terminal and a second electrode of the eighth transistor is connected to the second pull-down node; a gate electrode of the ninth transistor is connected to the second clock signal input terminal, a first electrode of the ninth transistor is connected to the second pull-up voltage terminal and a second electrode of the ninth transistor is connected to the second pull-down node; and a gate electrode of the tenth transistor is connected to the pull-up node, a first electrode of the tenth transistor is connected to the pull-down voltage terminal, and a second electrode of the tenth transistor is connected to the second pull-down node.

In an optional embodiment, the first pull-down circuit includes an eleventh transistor and a twelfth transistor; a gate electrode of the eleventh transistor is connected to the first pull-down node, a first electrode of the eleventh transistor is connected to the pull-down voltage terminal, and a second electrode of the eleventh transistor is connected to the pull-up node; and a gate electrode of the twelfth transistor is connected to the first pull-down node, a first electrode of the twelfth transistor is connected to the pull-down voltage terminal, and a second electrode of the twelfth transistor is connected to the signal output terminal.

In an optional embodiment, the second pull-down circuit includes a thirteenth transistor and a fourteenth transistor; a gate electrode of the thirteenth transistor is connected to the second pull-down node, a first electrode of the thirteenth transistor is connected to the pull-down voltage terminal, and a second electrode of the thirteenth transistor is connected to the pull-up node; and a gate electrode of the tenth transistor is connected to the pull-up node, a first electrode of the tenth transistor is connected to the pull-down voltage terminal, and a second electrode of the tenth transistor is connected to the second pull-down node.

In another aspect, the present disclosure provides in an embodiment a method for controlling any one of the display driving circuits as described above, comprising: collecting a voltage of the first pull-up voltage terminal or the second pull-up voltage terminal and outputting a characteristic voltage that conforms to characteristics of the voltage of the first pull-down circuit or the second pull-down circuit; comparing the characteristic voltage with a reference voltage of the reference voltage terminal; generating a timing control signal when the characteristic voltage is greater than or equal to the reference voltage; and causing the first pull-up voltage terminal or the second pull-up voltage terminal to output a DC voltage under the control of the timing control signal, thereby causing the first pull-down node and the second pull-down node to be simultaneously charged, and both the first pull-down circuit and the second pull-down circuit to be in a working state.

In a further aspect, the present disclosure provides in an embodiment a display device comprising any one of the display driving circuits as described above.

Embodiments of the present disclosure provide a display driving circuit, its control method and a display device, wherein the display driving circuit comprises a characteristic collector, a comparator, a timing controller and a gate driver. The gate driver comprises at least two cascade shift register units, the shift register unit comprising a first pull-down circuit connected to a first pull-down node and a second pull-down circuit connected to a second pull-down node; and the gate driver is provided with a first pull-up voltage terminal for charging the first pull-down node and a second pull-up voltage terminal for charging the second pull-down node. The characteristic collector is connected to a pull-down voltage terminal and a first input terminal of the comparator, and also to the first pull-up voltage terminal or the second pull-up voltage terminal; the characteristic collector is configured for collecting a voltage of the first pull-up voltage terminal or the second pull-up voltage terminal, and for outputting, to the first input terminal of the comparator, a characteristic voltage which conforms to characteristics of the voltage of the first pull-down circuit or the second pull-down circuit. A second input terminal of the comparator is connected to a reference voltage terminal; and an output terminal of the comparator is connected to the timing controller; and the comparator is configured for comparing the characteristic voltage with a reference voltage of the reference voltage terminal. The timing controller is further connected to the gate driver; and the timing controller is configured for receiving a comparison result from the comparator, and when the comparison result indicates that the characteristic voltage is greater than or equal to the reference voltage, the timing controller generates a timing control signal such that the first pull-up voltage terminal and the second pull-up voltage terminal are caused to output a DC voltage under the control of the timing control signal, thereby causing the first pull-down node and the second pull-down node to be simultaneously charged, and both the first pull-down circuit and the second pull-down circuit to be in a working state.

BRIEF DESCRIPTION OF THE DRAWINGS

In order to illustrate the technical solutions of the present disclosure or the related art in a clearer manner, the drawings desired for the present disclosure or the related art will be described hereinafter briefly. Obviously, the following drawings merely relate to some embodiments of the present disclosure, and based on these drawings, a person skilled in the art may obtain other drawings without any creative effort.

REFERENCE SIGNS

100: characteristic collector; 200: comparator; 300: timing controller; 400: gate driver; 10: pull-up control circuit; 20: pull-up circuit; 30: reset circuit; 40: first pull-down control circuit; 50: second pull-down control circuit; 60: first pull-down circuit; 70: second pull-down circuit; M1: first collection transistor; M2: second collection transistor; T1~T14: first transistor to fourteenth transistor; PU: pull-up node; PD1: first pull-down node; PD2: second pull-down node; VDD1: first pull-up voltage terminal; VDD2: second pull-up voltage terminal; VSS: pull-down voltage terminal; INPUT: signal input terminal; RESET: reset signal terminal; OUTPUT: signal output terminal; CLK: first clock signal input terminal; CLKB: second clock signal input terminal; CLK1: first system clock signal input terminal; CLK2: second system clock signal input terminal; Vref: reference voltage terminal; Vt: characteristic voltage: Vg: working voltage terminal; GND: ground terminal; STV: start signal terminal

DETAILED DESCRIPTION

Technical solutions in the embodiments of the present disclosure will be described in conjunction with the drawings in a clear and complete manner. Obviously, the described embodiments are merely part of the embodiments of the present disclosure and are not intended to be exhaustive. All other embodiments obtained by those having ordinary skill in the art based on these embodiments without any creative effort fall within the scope of the present disclosure.

Figure 1:
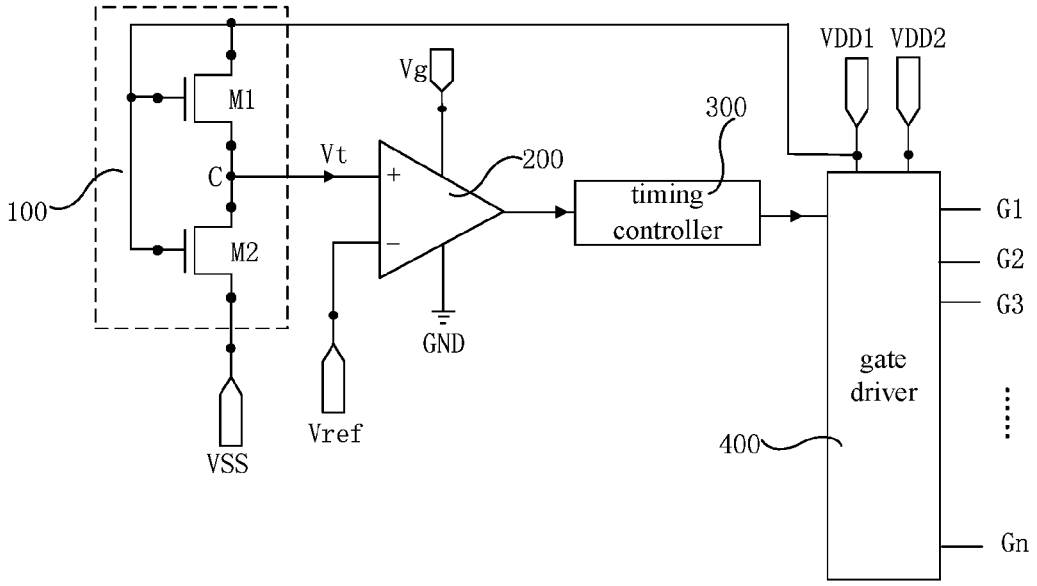
FIG. 1 is a structural schematic view of a display driving circuit provided in an embodiment of the present disclosure.

The present disclosure provides in an embodiment a display driving circuit which comprises a characteristic collector 100, a comparator 200, a timing controller 300 and a gate driver 400, as shown in FIG. 1.

Figure 2:
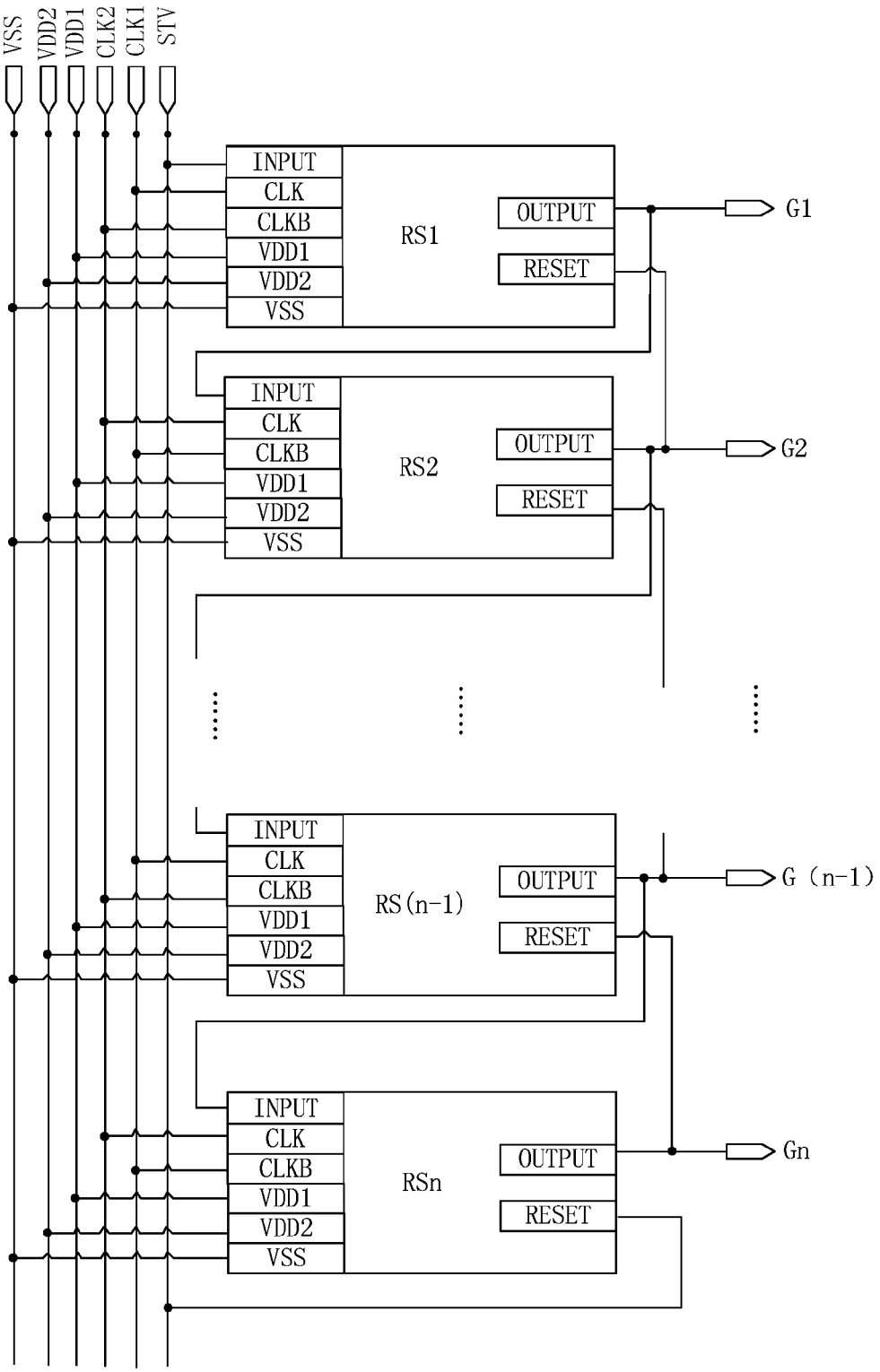
FIG. 2 is a structural schematic view of a gate driver in FIG. 1.

The gate driver 400 comprises at least two cascade shift register units (RS1, RS2, . . . , RSn), as shown in FIG. 2. A signal input terminal INPUT of a first level shift register unit RS1 is connected to a start signal terminal STV, and except for a first level shift register unit RS1, a signal output terminal OUTPUT of a certain level shift register unit RS(n−1) is connected to a signal input terminal INPUT of the next level shift register unit RS(n). The start signal terminal STV is configured for outputting a start signal, and the first level shift register unit RS1 of the gate driver 400 begins to progressively scan gate lines (G1, G2, . . . , Gn) after receiving the start signal.

In addition, except for the last level shift register unit RSn, a reset signal terminal RESET of a certain level shift register unit is connected to a signal output terminal OUTPUT of the previous level shift register unit. The reset signal terminal RESET of the last level shift register unit RSn can receive a reset signal that may be provided by an individual signal terminal, or may be connected to the start signal terminal STY. In this way, when the start signal of the start signal terminal STV is input into the signal input terminal INPUT of the first shift register unit RS1, the reset signal terminal RESET of the last level shift register unit RSn may reset the signal output terminal OUTPUT of the last level shift register unit RSn by using the start signal of the start signal terminal STV as a reset signal.

Figure 5:
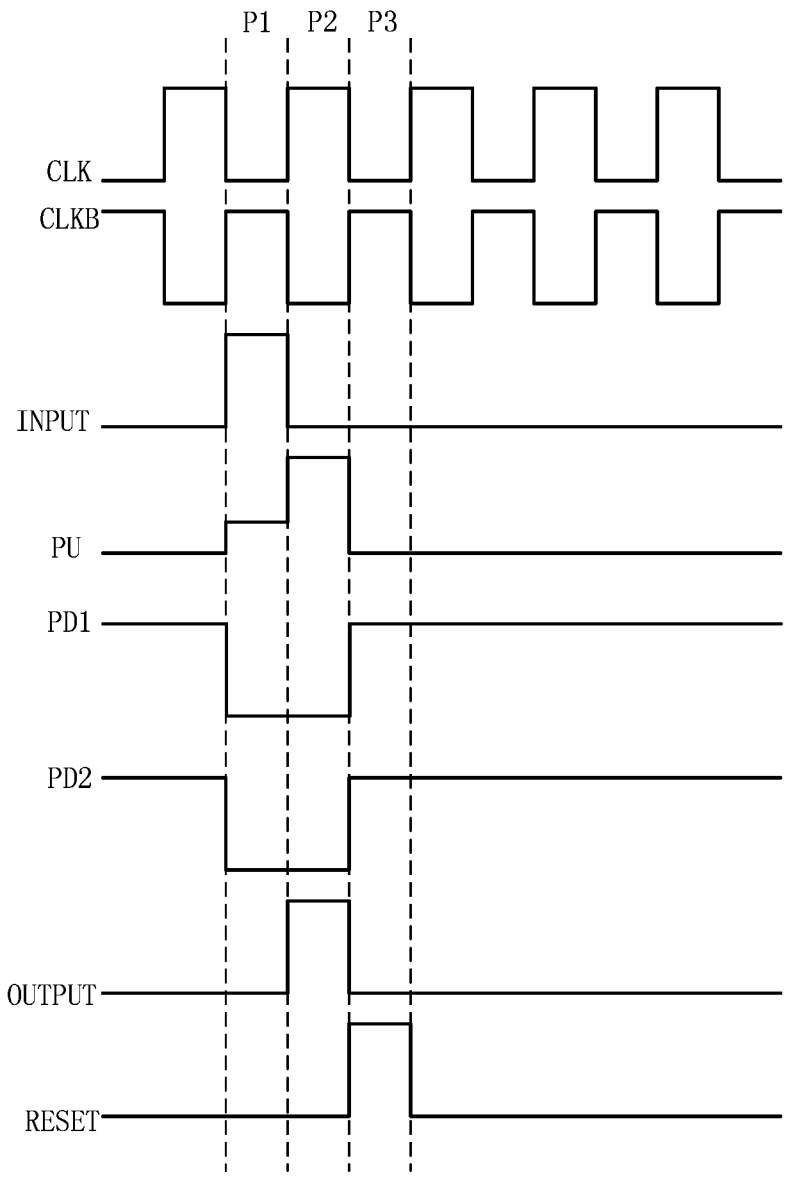
FIG. 5 is a timing diagram of a control signal for driving the shift register unit as shown in FIG. 4.

It shall be noted that, in order to make the first clock signal input terminal CLK and the second clock signal input terminal CLKB of each shift register unit output signals having the same waveform and amplitude and opposite phases as shown in FIG. 5, the first clock signal input terminal CLK and the second clock signal input terminal CLKB in different shift register units may be alternately connected to a first system clock signal input terminal CLK1 and a second system clock signal input terminal CLK2, respectively, as shown in FIG. 2.

For example, the first clock signal input terminal CLK of the first level shift register unit RS1 is connected to the first system clock signal input terminal CLK1 and the second clock signal input terminal CLKB is connected to the second system clock signal input terminal CLK2. The first clock signal input terminal CLK of the second level shift register unit RS2 is connected to the second system clock signal input terminal CLK2 and the second clock signal input terminal CLKB is connected to the first system clock signal input terminal CLK3. The following shift register units are connected as described above.

Figure 3:
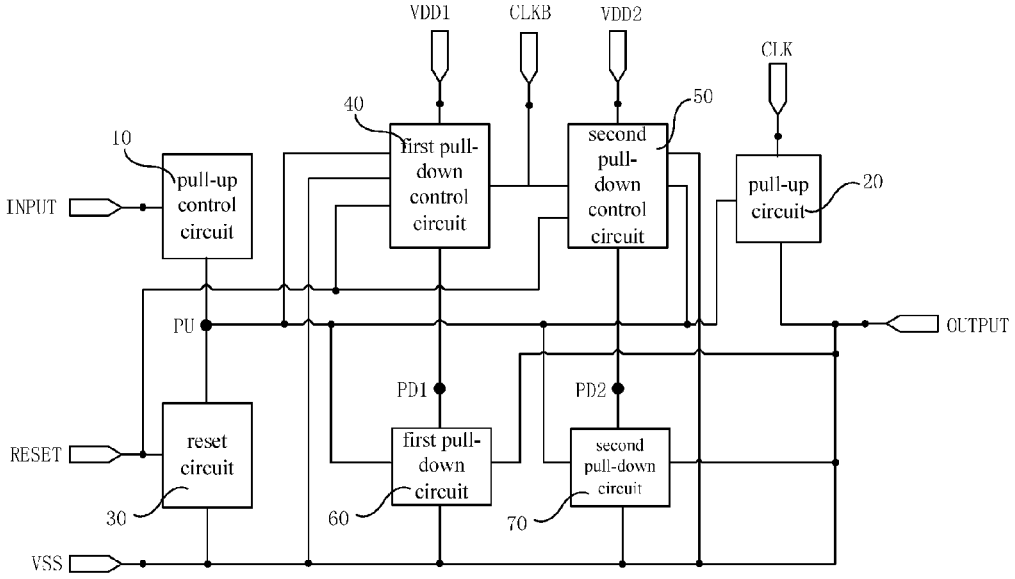
FIG. 3 is a structural schematic view of a shift register unit in FIG. 2.

On the basis of the above, a shift register unit in any level in the above gate driver 400 includes a first pull-down circuit 60 connected to the first pull-down node PD1 and a second pull-down circuit 70 connected to the second pull-down node PD2, as shown in FIG. 3. The gate driver 400 is provided with a first pull-up voltage terminal VDD1 for charging the first pull-down node PD1 and a second pull-up voltage terminal VDD2 for charging the second pull-down node PD2.

The characteristic collector 100 is connected to a pull-down voltage terminal VSS and a first input terminal of the comparator 200. Moreover, the characteristic collector 100 is further connected to the first pull-up voltage terminal VDD1 or the second pull-up voltage terminal VDD2, and configured for collecting a voltage of the first pull-up voltage terminal VDD1 or the second pull-up voltage terminal VDD2 and for outputting to the first input terminal of the comparator 200 a characteristic voltage Vt that conforms to characteristics of the voltage of the first pull-down circuit 60 or the second pull-down circuit 70.

The characteristics of the voltage of the first pull-down circuit 60 or the second pull-down circuit 70 refers to voltages associated with a bias voltage applied to the first pull-down circuit 60 or the second pull-down circuit 70 during operation. Based on this, the case where the characteristic voltage Vt conforms to the characteristics of the voltage of the first pull-down circuit 60 or the second pull-down circuit 70 means that the characteristic voltage Vt can characterize the lifetime of the first pull-down circuit 60 or the second pull-down circuit 70 working in a bias voltage state.

A second input terminal of the comparator 200 is connected to a reference voltage terminal Vref and an output terminal of the comparator 200 is connected to the timing controller 300, and the comparator 200 is configured for comparing the characteristic voltage Vt with a reference voltage of the reference voltage terminal Vref. In addition, the comparator 200 is further connected to a working voltage terminal Vg and a ground terminal GND, and the working voltage terminal Vg is configured for supplying a working voltage to the comparator.

The timing controller 300 is further connected to the gate driver 400 and configured for receiving a comparison result from the comparator 200, and when the comparison result indicates that the characteristic voltage Vt is greater than or equal to the reference voltage Vref, the timing controller 300 generates a timing control signal such that the first pull-up voltage terminal VDD1 and the second pull-up voltage terminal VDD2 output a DC voltage under the control of the timing control signal, thereby causing the first pull-down node PD1 and the second pull-down node PD2 to be simultaneously charged, and both the first pull-down circuit 60 and the second pull-down circuit 70 to be in a working state.

It shall be noted that, when the TFTs in the manufactured gate driver 400 have different sizes and effective working hours, the reference voltage Vref varies. Specifically, when a display substrate provided with the display driving circuit is selected as a sample, Vref may be first set to infinity, that is, the comparator 200 is in the non-working state. In this case, the first pull-down circuit 60 and the second pull-down circuit 70 alternately pull down a potential of the signal output terminal OUTPUT and of the pull-up node PU until a shift register unit is damaged and the gate driver 400 cannot work. At this time, the characteristic voltage Vt collected by the characteristic collector 100 is recorded as the above-mentioned reference voltage Vref.

Figure 6:
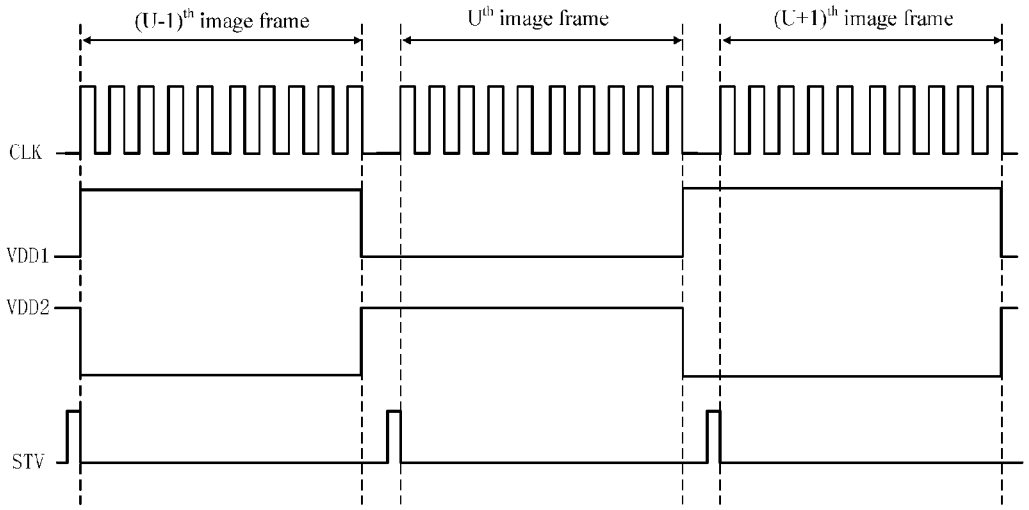
FIG. 6 is a waveform diagram of the control signal for driving the shift register unit as shown in FIG. 4 within multiple consecutive image frames.

During the alternate operation of the first pull-down circuit 60 and the second pull-down circuit 70, as shown in FIG. 6, within each image frame, such as, a $(U-1)^{th}$ image frame, a $U^{th}$ image frame or a $(U+1)^{th}$ image frame (where U is a positive integer≥1), the first pull-up voltage terminal VDD1 and the second pull-up voltage terminal VDD2 have opposite phases. For example, when the first pull-up voltage terminal VDD1 outputs a high level, the second pull-up voltage terminal VDD2 outputs a low level. Alternatively, when the second pull-up voltage terminal VDD2 outputs a high level, the first pull-up voltage terminal VDD1 outputs a low level. In this case, the first pull-down node PD1 and the second pull-down node PD2 are alternately charged.

Next, when the characteristic voltage Vt collected by the characteristic collector 100 is greater than or equal to the reference voltage Vref for other display substrates provided with the display driving circuit as described above, the first pull-up voltage terminal VDD1 and the second pull-up voltage terminal VDD2 output a DC voltage under the control of the timing control signal so that the first pull-down circuit 60 and the second pull-down circuit 70 are simultaneously turned on, and they together pull down the potential of the signal output terminal OUTPUT and of the pull-up node PU.

Figure 7:
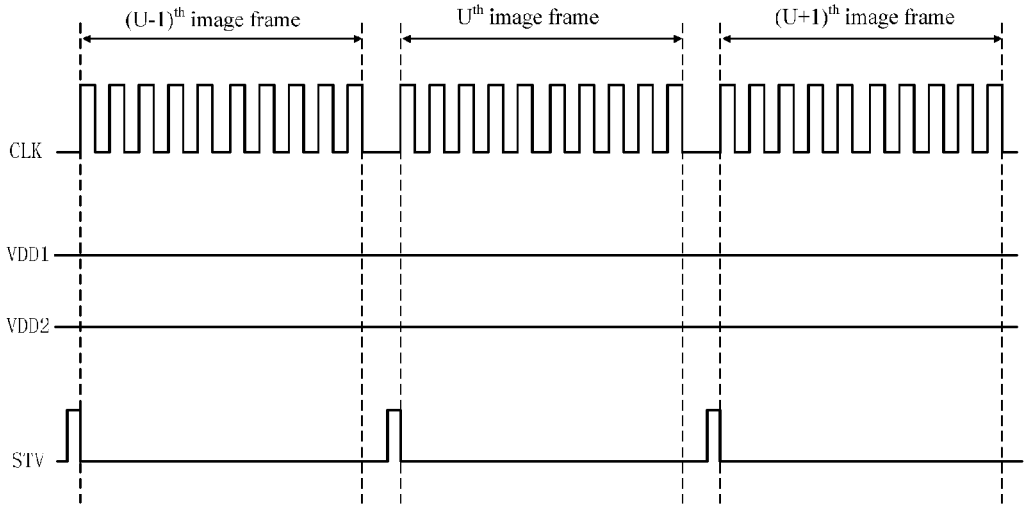
FIG. 7 is another waveform diagram of the control signal for driving the shift register unit as shown in FIG. 4 within multiple consecutive image frames.

In the course of simultaneously turning on the first pull-down circuit 60 and the second pull-down circuit 70, within the $(U-1)^{th}$ image frame, the $U^{th}$ image frame, the $(U+1)^{th}$ image frame, and so forth . . . , the first pull-up voltage terminal VDD1 and the second pull-up voltage terminal VDD2 output DV voltages under the control of the timing control signal, and the first pull-down node PD1 and the second pull-down node PD2 are simultaneously charged, as shown in FIG. 7.

In this way, since the characteristic voltage conforms to the characteristics of the voltage of the first pull-down circuit or the second pull-down circuit, the characteristic voltage can characterize the lifetime of the first pull-down circuit or the second pull-down circuit working in a bias voltage state. In this case, within an image frame, when the characteristic collector outputs a characteristic voltage larger than or equal to the reference voltage, it indicates that the first pull-down circuit or the second pull-down circuit is about to be or has been damaged, and that the first pull-down circuit and the second pull-down circuit will not be able to alternately pull down the potential of the signal output terminal of the shift register unit in the next image frame. In this case, the timing controller generates a timing control signal such that the first pull-down circuit and the second pull-down circuit can be simultaneously turned on in the next image frame under the control of the timing control signal. Therefore, even if one of the first full-down circuit and the second pull-down circuit is damaged and unable to work properly, the other one can still remain in the ON state during the non-output phase of the shift register unit such that the output terminal of the shift register unit remains in a non-output state so as to realize the normal operation of the gate driver.

The structure of any one of the shift register units in the gate driver will be described in detail below.

The shift register unit further comprises a pull-up control circuit 10, a pull-up circuit 20, a reset circuit 30, a first pull-down control circuit 40, and a second pull-down control circuit 50, as shown in FIG. 3.

The pull-up control circuit 10 is connected to the signal input terminal INPUT and the pull-up node PU, and configured for outputting a voltage of the signal input terminal INPUT to the pull-up node PU under the control of the signal input terminal INPUT.

The pull-up circuit 20 is connected to the first clock signal input terminal CLK, the pull-up node PU and the signal output terminal OUTPUT, and configured for outputting a signal of the first clock signal input terminal to the signal output terminal OUTPUT under the control of the pull-up node PU.

The reset circuit 30 is connected to the reset signal terminal RESET, the pull-down voltage terminal VSS, the pull-up node PU and the signal output terminal OUTPUT, and configured for pulling down a potential of the pull-up node PU and of the signal output terminal OUTPUT to a potential of the pull-down voltage terminal VSS under the control of the reset signal terminal RESET.

The first pull-down control circuit 40 is connected to the first pull-up voltage terminal VDD1, the second clock signal input terminal CLKB, the reset signal terminal RESET, the pull-up node PU, the first pull-down node PD1 and the pull-down voltage terminal VSS, and configured for outputting a voltage of the first pull-up voltage terminal VDD1 to the first pull-down node PD1 under the control of the second clock signal input terminal CLKB and the reset signal terminal RESET, or for pulling down the potential of the first pull-down node PD1 to the potential of the pull-down voltage terminal VSS under the control of the pull-up node PU.

The second pull-down control circuit 50 is connected to the second pull-up voltage terminal VDD2, the second clock signal input terminal CLKB, the reset signal terminal RESET, the pull-up node PU, the second pull-down node PD2, and the pull-down voltage terminal VSS, and configured for outputting the voltage of the second pull-up voltage terminal VDD2 to the second pull-down node PD2 under the control of the second clock signal input terminal CLKB and the reset signal terminal RESET, or for pulling down the potential of the second pull-down node PD2 to the potential of the pull-down voltage terminal VSS under the control of the pull-up node PU.

The first pull-down circuit 60 is further connected to the pull-up node PU, the signal output terminal OUTPUT and the pull-down voltage terminal VSS, and configured for respectively pulling down the potential of the pull-up node PU and of the signal output terminal OUTPUT to the potential of the pull-down voltage terminal VSS under the control of the first pull-down node PD1.

The second pull-down circuit 70 is further connected to the pull-up node PU, the signal output terminal OUTPUT and the pull-down voltage terminal VSS, and configured for respectively pulling down the potential of the pull-up node PU and of the signal output terminal OUTPUT to the potential of the pull-down voltage terminal VSS under the control of the second pull-down node PD2.

The specific structure of each circuit in the shift register will be described in detail below.

In this case, the pull-up control circuit 10 comprises a first transistor T1, a gate electrode and a first electrode of the first transistor T1 is connected to the signal input terminal INPUT, and a second electrode of the first transistor T1 is connected to the pull-up node PU.

The pull-up circuit 20 comprises a second transistor T2 and a first capacitor C1.

A gate electrode of the second transistor T2 is connected to the pull-up node PU, a first electrode of the second transistor T2 is connected to the first clock signal input terminal CLK, and a second electrode of the second transistor T2 is connected to the signal output terminal OUTPUT.

A first end of the first capacitor C1 is connected to the pull-up node PU, and a second end of the first capacitor C1 is connected to the signal output terminal OUTPUT.

The reset circuit 30 comprises a third transistor T3 and a fourth transistor T4.

A gate electrode of the third transistor T3 is connected to the reset signal terminal RESET, a first electrode of the third transistor T3 is connected to the pull-down voltage terminal VSS, and a second electrode of the third transistor T3 is connected to the pull-up node PU.

A gate electrode of the fourth transistor T4 is connected to the reset signal terminal RESET, a first electrode of the fourth transistor T4 is connected to the pull-down voltage terminal VSS, and a second electrode of the fourth transistor T4 is connected to the signal output terminal OUTPUT.

The first pull-down control circuit 40 includes a fifth transistor T5, a sixth transistor T6, and a seventh transistor T7.

A gate electrode of the fifth transistor T5 is connected to the second clock signal input terminal CLKB, a first electrode of the fifth transistor T5 is connected to the first pull-up voltage terminal VDD1, and a second electrode of the fifth transistor T5 is connected to the first pull-down node PD1.

A gate electrode of the sixth transistor T6 is connected to the reset signal terminal RESET, a first electrode of the sixth transistor T6 is connected to the first pull-up voltage terminal VDD1, and a second electrode of the sixth transistor T6 is connected to the first pull-down node PD1.

A gate electrode of the seventh transistor T7 is connected to the pull-up node PU, a first electrode of the seventh transistor T7 is connected to the pull-down voltage terminal VSS, and a second electrode of the seventh transistor T7 is connected to the first pull-down node PD1.

The second pull-down control circuit 50 includes an eighth transistor T8, a ninth transistor T9, and a tenth transistor T10.

A gate electrode of the eighth transistor T8 is connected to the reset signal terminal RESET, a first electrode of the eighth transistor T8 is connected to the second pull-up voltage terminal VDD2, and a second electrode of the eighth transistor T8 is connected to the second pull-down node PD2.

A gate electrode of the ninth transistor T9 is connected to the second clock signal input terminal CLKB, a first electrode of the ninth transistor T9 is connected to the second pull-up voltage terminal VDD2, and a second electrode of the ninth transistor T9 is connected to the second pull-down node PD2.

A gate electrode of the tenth transistor T10 is connected to the pull-up node PU, a first electrode of the tenth transistor T10 is connected to the pull-down voltage terminal VSS, and a second electrode of the tenth transistor T10 is connected to the second pull-down node PD2.

The first pull-down circuit 60 includes an eleventh transistor T11 and a twelfth transistor T12.

A gate electrode of the eleventh transistor T11 is connected to the first pull-down node PD1, a first electrode of the eleventh transistor T11 is connected to the pull-down voltage terminal VSS, and a second electrode of the eleventh transistor T11 is connected to the pull-up node PU.

A gate electrode of the twelfth transistor T12 is connected to the first pull-down node PD1, a first electrode of the twelfth transistor T12 is connected to the pull-down voltage terminal VSS, and a second electrode of the twelfth transistor T12 is connected to the signal output terminal OUTPUT.

The second pull-down circuit 70 includes a thirteenth transistor T13 and a fourteenth transistor T14.

A gate electrode of the thirteenth transistor T13 is connected to the second pull-down node PD2, a first electrode of the thirteenth transistor T13 is connected to the pull-down voltage terminal VSS, and a second electrode of the thirteenth transistor T13 is connected to the pull-up node PU.

A gate electrode of the fourteenth transistor T14 is connected to the second pull-down node PD2, a first electrode of the fourteenth transistor T14 is connected to the pull-down voltage terminal VSS, and a second electrode of the fourteenth transistor T14 is connected to the signal output terminal OUTPUT.

On the basis of this, as shown in FIG. 1, the characteristic collector 100 may comprise a first collection transistor M1 and a second collection transistor M2.

The first collection transistor M1 and the second collection transistor M2 are connected as follows:

For example, when the characteristic collector 100 is configured for collecting a voltage of the first pull-up voltage terminal VDD1, a gate electrode and a first electrode of the first collection transistor M1 are connected to the first pull-up voltage terminal VDD1 and a second electrode of the first collection transistor M1 is connected to a first electrode of the second collection transistor M2.

The gate electrode of the second collection transistor M2 is connected to the first pull-up voltage terminal VDD1, the first electrode of the second collection transistor M2 is connected to the pull-down voltage terminal VSS, and a second electrode of the second collection transistor M2 is connected to the first input terminal of the comparator 200.

For another example, when the characteristic collector 100 is configured for collecting a voltage of the second pull-up voltage terminal VDD2, the gate electrode and the first electrode of the first collection transistor M1 are connected to the second pull-up voltage terminal VDD2, and the second electrode of the first collection transistor M1 is connected to the first electrode of the second collection transistor M2.

The gate electrode of the second collection transistor M2 is connected to the second pull-up voltage terminal VDD2, the first electrode of the second collection transistor M2 is connected to the pull-down voltage terminal VSS, and the second electrode of the second collection transistor M2 is connected to the first input terminal of the comparator 200.

Figure 4:
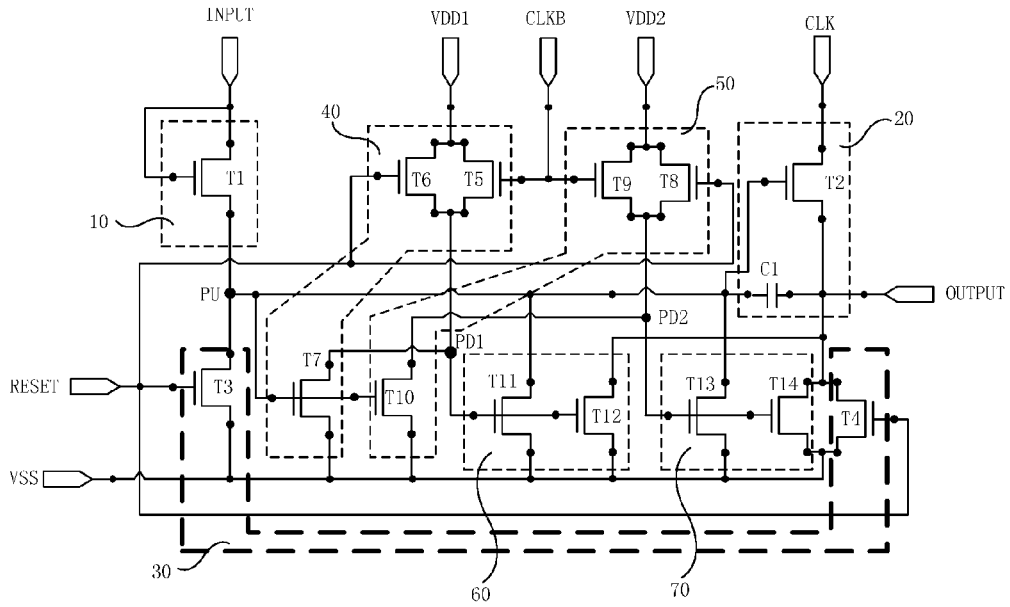
FIG. 4 is a specific structural schematic view of respective circuits in the shift register unit in FIG. 3.

As can be seen from FIGS. 1 and 4, the embodiment is illustrated by taking all the transistors as N-type transistors for example, and when the gate electrode and the first electrode of the first collection transistor M1 are connected to the first pull-up voltage terminal VDD1 and the gate electrode of the second collection transistor M2 is connected to the first pull-up voltage terminal VDD1, a gate-source voltage Vgs of the second collection transistor M2 equals VDD1 minus VSS, i.e., Vgs=VDD1−VSS, which is the same as a bias voltage applied to the eleventh transistor T11 and the twelfth transistor T12 in the first pull-down circuit 60. Thus, the change in the characteristics of the second collection transistor M2 may reflect the lifetime of the eleventh transistor T11 and the twelfth transistor T12.

Alternatively, when the gate electrode and the first electrode of the second collection transistor M2 are connected to the second pull-up voltage terminal VDD2 and the gate electrode of the second collection transistor M2 is connected to the second pull-up voltage terminal VDD2, the gate-source voltage Vgs of the second collection transistor M2 equals VDD2 minus VSS, i.e., Vgs=VDD2−VSS, which is the same as a bias voltage applied to the thirteenth transistor T13 and the fourteenth transistor T14 in the second pull-down circuit 70. Thus, the change in the characteristics of the second collection transistor M2 may reflect the lifetime of the thirteenth transistor T13 and the fourteenth transistor T14.

In this case, as shown in FIG. 1, the first collection transistor M1 and the second collection transistor M2 constituting the characteristic collector 100 may be regarded as two resistors connected in series. The first collection transistor M1 may become a resistor having a certain resistance since its gate electrode and first electrode are short circuited, while the second collection transistor M2 may become a variable resistor since its characteristics are affected and changed by the bias voltage. When the display driving circuit works for a long period of time, the on-state performance of the second collection transistor M2 is lowered, its own resistance value is increased and the current flowing through the first collection transistor M1 and the second collection transistor M2 is reduced. Since the resistance of the first transistor M1 is unchanged, a voltage drop across the first transistor M1 is reduced, that is, |VDD1−Vt| decreases or |VDD2−Vt| decreases, thereby resulting in an increase in the characteristic voltage Vt. At this moment, the characteristic voltage Vt can be compared with the set reference voltage Vref. When the characteristic voltage Vt is greater than or equal to Vref, it means that the lifetime of the second collection transistor M2 is close to the limit and also that the lifetimes of the transistors in the first pull-down circuit 60 or the second pull-down circuit 70 are close to the limit. Accordingly, the first pull-down circuit 60 and the second pull-down circuit 70 cannot work alternately, and may work simultaneously by causing the first pull-up voltage terminal VDD1 and the second pull-up voltage terminal VDD2 to output direct current (DC) voltages, so as to ensure that the output terminal of the shift register unit remains in the non-output state.

It shall be noted that, in order to strengthen the second electrode of the second collection transistor M2, that is, the characteristic collector 100 is configured for outputting amplitude of variations of the characteristic voltage Vt at the node C so as to facilitate the collection of the characteristic voltage Vt. In an optional embodiment, the second collection transistor M2 may have a size larger than that of the first collection transistor M1. However, the sizes of the collection transistors in the embodiments of the present disclosure are not limited hereto.

The ON and OFF conditions of the transistors in the shift register unit as shown in FIG. 4 in different phases (P1 to P4) of an image frame (such as the $U^{th}$ image frame) will be illustrated in detail by taking all the transistors as N-type transistors for example and in conjunction with FIG. 5. In addition, the embodiments of the present disclosure are illustrated by taking the fact that the first pull-up voltage terminal VDD1 and the second pull-up voltage terminal VDD2 constantly output a high level and the pull-down voltage terminal VSS constantly outputs a low level for example.

In this case, in an input phase P1, INPUT=1, RESET=0, CLK=0, and CLKB=1, wherein "0" represents a low level, and "1" represents a high level.

In this case, since the signal input terminal INPUT outputs a high level, the first transistor T1 is turned on such that the high level of the signal input terminal INPUT is outputted to the pull-up node PU and stored by the first capacitor C1. Under the control of the pull-up node PU, the second transistor T2 is turned on, and outputs the low level of the first clock signal input terminal CLK to the signal output terminal OUTPUT.

Under the control of the high level of the pull-up node PU, the seventh transistor T7 and the tenth transistor T10 are turned on. Therefore, even if the high level of the second clock signal input terminal CLKB causes the fifth transistor T5 and the eighth transistor T8 to be turned on, a potential of the first pull-down node PD1 can still be pulled down to the potential of the pull-down voltage terminal VSS by the tenth transistor T10. In this case, the eleventh transistor T11, the twelfth transistor T12, the thirteenth transistor T13, and the fourteenth transistor T14 are all in an OFF state.

Furthermore, since the reset signal terminal RESET inputs a low level, the third transistor T3, the fourth transistor T4, the sixth transistor T6 and the eighth transistor T8 are all in an OFF state.

To sum up, the signal output terminal OUTPUT outputs a low level in the above input phase P1.

In an output phase P2, INPUT=0, RESET=0, CLK=1 and CLKB=0.

In this case, since the signal input terminal INPUT outputs a low level, the first transistor T1 is in an OFF state. The first capacitor C1 charges the pull-up node PU by using the high level stored in the input phase P1 such that the second transistor T2 remains in an ON state. Therefore, the high level of the first clock signal input terminal CLK is outputted to the signal output terminal OUTPUT by the second transistor T2. Moreover, under the action of bootstrapping of the first capacitor C1, the potential of the pull-up node PU is further increased to maintain the second transistor T2 in the ON state, such that the high level of the first clock signal input terminal CLK can be outputted as a gate scanning signal to a gate line connected to the signal output terminal OUTPUT.

In addition, the ON and OFF states of the first pull-down node PD1, the second pull-down node PD2 and the remaining transistors are the same as those in the input phase P1, and will not be repeated here.

To sum up, the signal output terminal OUTPUT outputs a high level in the output phase P2 so as to output a gate scanning signal to the gate line connected to the signal output terminal OUTPUT.

In a reset phase P3, INPUT=0, RESET=1, CLK=0 and CLKB=1.

In this case, since the reset signal terminal RESET outputs a high level, the third transistor T3 is turned on and thus pulls down the potential of the pull-up node PU to a low level of the pull-down voltage terminal VSS, so as to reset the pull-up node PU; the fourth transistor T4 is turned on and thus pulls down the potential of the signal output terminal OUTPUT to a low level of the pull-down voltage terminal VSS, so as to reset the signal output terminal OUTPUT. Further, the sixth transistor is turned on and the second clock signal input terminal CLKB outputs a high level to turn on the fifth transistor T5, and the high level of the first pull-up voltage terminal VDD1 is outputted to the first pull-up node PD1; the ninth transistor T9 is turned on and the second clock signal input terminal CLKB outputs a high level to turn on the eighth transistor T8, and the high level of the second pull-up terminal VDD2 is outputted to the second pull-up node PD2.

Based on this, under the control of the first pull-up node PD1, the tenth transistor T10 is turned on to pull down the potential of the pull-up node PU to the potential of pull-down voltage terminal VSS, and the twelfth transistor T12 is turned on to pull down the voltage of the signal output terminal OUTPUT to the voltage of the pull-down voltage terminal VSS. Further, under the control of the second pull-up node, the thirteenth transistor T13 is turned on to pull down the potential of the pull-up node PU to the potential of the pull-down voltage terminal VSS, and the fourteenth transistor T14 is turned on to pull down the voltage of the signal output terminal OUTPUT to the voltage of the pull-down voltage terminal VSS.

In addition, the signal input terminal INPUT outputs a low level, the first transistor T1 is turned off, the pull-up node PU is at a low level, and the second transistor T2 is turned off.

To sum up, since the potential of the signal output terminal OUTPUT in this phase is pulled down to a low level, no gate scanning signal is output and the shift register unit is in a non-output phase. The shift register unit is in the non-output phase before scanning in the next image frame (such as the $(U+1)^{th}$ image frame), i.e., when the start signal terminal STV outputs a high level again as shown in FIGS. 6 and 7.

In shall be noted that, in order to make the shift register unit in the non-output phase prior to the next image frame (such as the $(U+1)^{th}$ image frame)), the fifth transistor T5 and the ninth transistor T9 may be turned on by the second clock signal input terminal CLKB, thereby outputting the voltage of the first pull-up voltage terminal VDD1 to the first pull-down node PD1. When the first pull-up voltage terminal VDD1 outputs a high level, the first pull-down node PD1 can turn on the first pull-down circuit 60. Furthermore, in the case where the ninth transistor T9 is turned on, the voltage of the second pull-up voltage terminal VDD2 is outputted to the second pull-down node PD2, and when the second pull-up voltage terminal VDD2 outputs a high level, the second pull-down node PD2 can turn on the first pull-down circuit 70.

Specifically, as shown in FIG. 1, when the characteristic collector 100 is connected to the first pull-up voltage terminal VDD1, the change in the characteristics of the second collection transistor M2 in the characteristic collector 100 may reflect the lifetime of the eleventh transistor T11 and the twelfth transistor T12 in the first pull-down circuit 60. In this case, when the display driving circuit starts to work and when the shift register unit is in the non-output phase, the pull-up voltage terminal VDD1 and the second pull-up voltage terminal VDD2 may have timing diagrams as shown in FIG. 6, thereby making it possible to alternately charge the first pull-up node PD1 and the second pull-up node PD2 and alternately operate the first pull-down circuit 60 and the second pull-down circuit 70. As a result, the condition that one of the pull-down circuits is in a working state for a long period of time is avoided. When the characteristic voltage Vt collected by the characteristic collector 100 is greater than or equal to the reference voltage Vref, it means that the lifetime of the second collection transistor M2 is close to the limit and also that the lifetimes of the eleventh transistor T11 and the twelfth transistor T12 in the first pull-down unit 60 are also close to the limit. In this case, if the first pull-down circuit 60 and the second pull-down circuit 70 still work alternately, the shift register unit will not be in the non-output phase.

In order to solve this problem, the timing controller 300 needs to output a timing control signal such that the timing diagrams of the of the first pull-up voltage terminal VDD1 and the second pull-up voltage terminal VDD2 can be as shown in FIG. 7, thereby making it possible to cause the first pull-up node PD1 and the second pull-up node PD2 to be simultaneously charged and the first pull-down circuit 60 and the second pull-down circuit 70 to work at the same time. Therefore, even if the first pull-down circuit 60 is damaged, the second pull-down circuit 70 can still pull down the potential of the signal output terminal OUTPUT such that the shift register unit is still in the non-output phase before scanning in the next image frame.

Of course, the above is exemplified by the fact that the characteristic collector 100 is connected to the first pull-up voltage terminal VDD1 to control the alternate or simultaneous operation of the first pull-down circuit 60 and the second pull-down circuit 70. When the characteristic collector 100 is connected to the second pull-up voltage terminal VDD2, the control method is available for the same reasons and will not be repeated here.

It should be noted that the ON and OFF processes of the transistors in the above-described embodiment are illustrate by taking all the transistors as N-type transistors for example. The transistors may be all P-type transistors, and the control process is available for the same reasons, and will not be repeated here.

Figure 8:
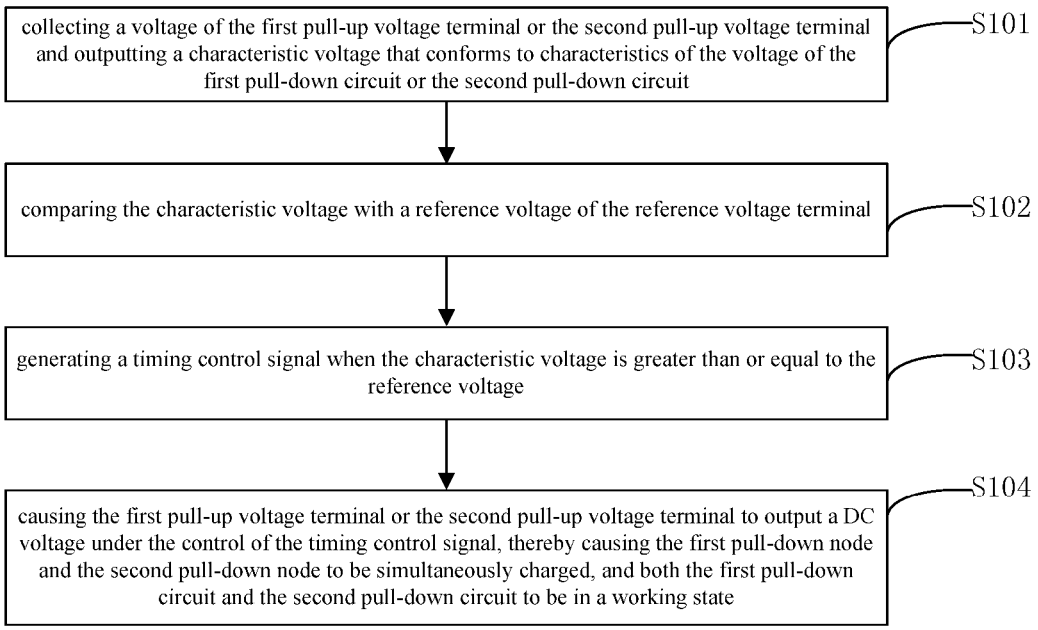
FIG. 8 is a flow chart of a method for controlling the display driving circuit provided in the embodiment of the present disclosure.

The present disclosure provides in an embodiment a method for controlling any of the display driving circuits as described above, as shown in FIG. 8. In the case where the display driving circuit comprises a gate driver 400 as shown in FIG. 1, the gate driver 400 comprises at least two cascade shift register units (RS1, RS2, . . . ) as shown in FIG. 4, and the shift register unit comprises a first pull-down circuit 60 and a second pull-down circuit 70 as shown in FIG. 3, the method for controlling the display driving circuit is as shown in FIG. 8 and comprises the following steps:

Step S101: collecting a voltage of the first pull-up voltage terminal VDD1 or the second pull-up voltage terminal VDD2 and outputting a characteristic voltage Vt that conforms to characteristics of the voltage of the first pull-down circuit 60 or the second pull-down circuit 70;

Step S102: comparing the characteristic voltage Vt with a reference voltage of the reference voltage terminal Vref;

Step S103: generating a timing control signal when the characteristic voltage Vt is greater than or equal to the reference voltage Vref; and Step S104: causing the first pull-up voltage terminal VDD1 or the second pull-up voltage terminal VDD2 to output a DC voltage under the control of the timing control signal (as shown in FIG. 7), thereby causing the first pull-down node PD1 and the second pull-down node PD2 to be simultaneously charged, and both the first pull-down circuit 60 and the second pull-down circuit 70 to be in a working state.

In this way, since the characteristic voltage conforms to the characteristics of the voltage of the first pull-down circuit or the second pull-down circuit, the characteristic voltage can characterize the lifetime of the first pull-down circuit or the second pull-down circuit working in a bias voltage state. Therefore, within an image frame, when the characteristic collector outputs a characteristic voltage larger than or equal to the reference voltage, it indicates that the first pull-down circuit or the second pull-down circuit is about to be or has been damaged, and that the first pull-down circuit and the second pull-down circuit will not be able to alternately pull down the potential of the signal output terminal of the shift register unit in the next image frame. Therefore, the timing controller generates a timing control signal such that the first pull-down circuit and the second pull-down circuit can be simultaneously turned on in the next image frame under the control of the timing control signal. In this case, even if one of the first full-down circuit and the second pull-down circuit is damaged and unable to work properly, the other one can still remain in the ON state during the non-output phase of the shift register unit such that the output terminal of the shift register unit remains in a non-output state so as to realize the normal operation of the gate driver.

The present disclosure provides in an embodiment a display device comprising any of the display driving circuits as described above, which has the same structure and advantageous effect as the display driving circuit provided in the previous embodiment. Since the structure and advantageous effect have been described above in detail, and will not be repeated here.

The above are merely the preferred embodiments of the present disclosure, and the protection scope of the present disclosure is not limited thereto. It should be appreciated that, a person skilled in the art may make further modifications or improvements without departing from the principle of the present disclosure, and these modifications and improvements shall also fall within the scope of the present disclosure. Therefore, the protection scope of the present disclosure shall be based on the protection scope of the claims.

What is claimed is:

1. A display driving circuit, comprising a characteristic collector, a comparator, a timing controller and a gate driver;

wherein the gate driver comprises at least two cascade shift register units, each of the at least two cascade shift register units comprising a first pull-down circuit connected to a first pull-down node and a second pull-down circuit connected to a second pull-down node; and the gate driver is provided with a first pull-up voltage terminal for charging the first pull-down node and a second pull-up voltage terminal for charging the second pull-down node;

wherein the characteristic collector is connected to a pull-down voltage terminal and a first input terminal of the comparator, and also to the first pull-up voltage terminal or the second pull-up voltage terminal; the characteristic collector is configured for collecting a voltage of the first pull-up voltage terminal or the second pull-up voltage terminal, and for outputting, to the first input terminal of the comparator, a characteristic voltage which conforms to characteristics of the voltage of the first pull-down circuit or the second pull-down circuit;

wherein a second input terminal of the comparator is connected to a reference voltage terminal and an output terminal of the comparator is connected to the timing controller; and the comparator is configured for comparing the characteristic voltage with a reference voltage of the reference voltage terminal; and wherein the timing controller is further connected to the gate driver; and the timing controller is configured for receiving a comparison result from the comparator, and when the comparison result indicates that the characteristic voltage is greater than or equal to the reference voltage, the timing controller generates a timing control signal such that the first pull-up voltage terminal and the second pull-up voltage terminal are caused to output a DC voltage under the control of the timing control signal, thereby causing the first pull-down node and the second pull-down node to be simultaneously charged, and both the first pull-down circuit and the second pull-down circuit to be in a working state.

2. The display driving circuit according to claim 1, wherein the characteristic collector comprises a first collection transistor and a second collection transistor;

a second electrode of the first collection transistor is connected to a first electrode of the second collection transistor; the first electrode of the second collection transistor is connected to the pull-down voltage terminal; and a second electrode of the second collection transistor is connected to the first input terminal of the comparator; and a gate electrode and a first electrode of the first collection transistor are connected to the first pull-up voltage terminal, and a gate electrode of the second collection transistor is connected to the first pull-up voltage terminal, or wherein the characteristic collector comprises a first collection transistor and a second collection transistor;

a second electrode of the first collection transistor is connected to a first electrode of the second collection transistor; the first electrode of the second collection transistor is connected to the pull-down voltage terminal; and a second electrode of the second collection transistor is connected to the first input terminal of the comparator; and a gate electrode and a first electrode of the first collection transistor are connected to the second pull-up voltage terminal, and a gate electrode of the second collection transistor is connected to the second pull-up voltage terminal.

3. The display driving circuit according to claim 1, wherein each of the at least two cascade shift register units further comprises a pull-up control circuit, a pull-up circuit, a reset circuit, a first pull-down control circuit and a second pull-down control circuit;

the pull-up control circuit is connected to a signal input terminal and a pull-up node, and configured for outputting a voltage of the signal input terminal to the pull-up node under the control of the signal input terminal;

the pull-up circuit is connected to a first clock signal input terminal, the pull-up node and a signal output terminal, and configured for outputting a signal of the first clock signal input terminal to the signal output terminal under the control of the pull-up node;

the reset circuit is connected to a reset signal terminal, the pull-down voltage terminal, the pull-up node and the signal output terminal, and configured for respectively pulling down a potential of the pull-up node and of the signal output terminal to a potential of the pull-down voltage terminal under the control of the reset signal terminal;

the first pull-down control circuit is connected to the first pull-up voltage terminal, a second clock signal input terminal, the reset signal terminal, the pull-up node, the first pull-down node and the pull-down voltage terminal, and configured for outputting a voltage of the first pull-up voltage terminal to the first pull-down node under the control of the second clock signal input terminal and the reset signal terminal, or for pulling down a potential of the first pull-down node to the potential of the pull-down voltage terminal under the control of the pull-up node;

the second pull-down control circuit is connected to the second pull-up voltage terminal, the second clock signal input terminal, the reset signal terminal, the pull-up node, the second pull-down node and the pull-down voltage terminal, and configured for outputting a voltage of the second pull-up voltage terminal to the second pull-down node under the control of the second clock signal input terminal and the reset signal terminal, or for pulling down a potential of the second pull-down node to the potential of the pull-down voltage terminal under the control of the pull-up node;

the first pull-down circuit is further connected to the pull-up node, the signal output terminal and the pull-down voltage terminal, and configured for respectively pulling down a potential of the pull-up node and of the signal output terminal to the potential of the pull-down voltage terminal under the control of the first pull-down node; and the second pull-down circuit is further connected to the pull-up node, the signal output terminal and the pull-down voltage terminal, and configured for respectively pulling down the potential of the pull-up node and of the signal output terminal to the potential of the pull-down voltage terminal under the control of the second pull-down node.

4. The display driving circuit according to claim 3, wherein the pull-up control circuit includes a first transistor, and a gate electrode and a first electrode of the first transistor are connected to the signal input terminal, and a second electrode of the first transistor is connected to the pull-up node.

5. The display driving circuit according to claim 3, wherein the pull-up circuit includes a second transistor and a first capacitor;

a gate electrode of the second transistor is connected to the pull-up node, a first electrode of the second transistor is connected to the first clock signal input terminal and a second electrode of the second transistor is connected to the signal output terminal; and a first end of the first capacitor is connected to the pull-up node and a second end of the first capacitor is connected to the signal output terminal.

6. The display driving circuit according to claim 3, wherein the reset circuit includes a third transistor and a fourth transistor;

a gate electrode of the third transistor is connected to the reset signal terminal, a first electrode of the third transistor is connected to the pull-down voltage terminal, and a second electrode of the third transistor is connected to the pull-up node; and a gate electrode of the fourth transistor is connected to the reset signal terminal, a first electrode of the fourth transistor is connected to the pull-down voltage terminal, and a second electrode of the fourth transistor is connected to the signal output terminal.

7. The display driving circuit according to claim 3, wherein the first pull-down control circuit includes a fifth transistor, a sixth transistor, and a seventh transistor;

a gate electrode of the fifth transistor is connected to the second clock signal input terminal, a first electrode of the fifth transistor is connected to the first pull-up voltage terminal and a second electrode of the fifth transistor is connected to the first pull-down node;

a gate electrode of the sixth transistor is connected to the reset signal terminal, a first electrode of the sixth transistor is connected to the first pull-up voltage terminal and a second electrode of the sixth transistor is connected to the first pull-down node; and a gate electrode of the seventh transistor is connected to the pull-up node, a first electrode of the seventh transistor is connected to the pull-down voltage terminal, and the second electrode of the seventh transistor is connected to the first pull-down node.

8. The display driving circuit according to claim 3, wherein the second pull-down control circuit includes an eighth transistor, a ninth transistor, and a tenth transistor;

a gate electrode of the eighth transistor is connected to the reset signal terminal, a first electrode of the eighth transistor is connected to the second pull-up voltage terminal and a second electrode of the eighth transistor is connected to the second pull-down node;

a gate electrode of the ninth transistor is connected to the second clock signal input terminal, a first electrode of the ninth transistor is connected to the second pull-up voltage terminal and a second electrode of the ninth transistor is connected to the second pull-down node; and a gate electrode of the tenth transistor is connected to the pull-up node, a first electrode of the tenth transistor is connected to the pull-down voltage terminal, and a second electrode of the tenth transistor is connected to the second pull-down node.

9. The display driving circuit according to claim 3, wherein the first pull-down circuit includes an eleventh transistor and a twelfth transistor;

a gate electrode of the eleventh transistor is connected to the first pull-down node, a first electrode of the eleventh transistor is connected to the pull-down voltage terminal, and a second electrode of the eleventh transistor is connected to the pull-up node; and a gate electrode of the twelfth transistor is connected to the first pull-down node, a first electrode of the twelfth transistor is connected to the pull-down voltage terminal, and a second electrode of the twelfth transistor is connected to the signal output terminal.

10. The display driving circuit according to claim 3, wherein the second pull-down circuit includes a thirteenth transistor and a fourteenth transistor;

a gate electrode of the thirteenth transistor is connected to the second pull-down node, a first electrode of the thirteenth transistor is connected to the pull-down voltage terminal, and a second electrode of the thirteenth transistor is connected to the pull-up node; and a gate electrode of the fourteenth transistor is connected to the second pull-down node, a first electrode of the fourteenth transistor is connected to the pull-down voltage terminal, and a second electrode of the fourteenth transistor is connected to the signal output terminal.

11. A method for controlling a display driving circuit, wherein the display driving circuit comprises a characteristic collector, a comparator, a timing controller and a gate driver;

wherein the gate driver comprises at least two cascade shift register units, each of the at least two cascade shift register units comprising a first pull-down circuit connected to a first pull-down node and a second pull-down circuit connected to a second pull-down node; and the gate driver is provided with a first pull-up voltage terminal for charging the first pull-down node and a second pull-up voltage terminal for charging the second pull-down node;

wherein the characteristic collector is connected to a pull-down voltage terminal and a first input terminal of the comparator, and also to the first pull-up voltage terminal or the second pull-up voltage terminal; the characteristic collector is configured for collecting a voltage of the first pull-up voltage terminal or the second pull-up voltage terminal, and for outputting, to the first input terminal of the comparator, a characteristic voltage which conforms to characteristics of the voltage of the first pull-down circuit or the second pull-down circuit;

wherein a second input terminal of the comparator is connected to a reference voltage terminal, and an output terminal of the comparator is connected to the timing controller; and the comparator is configured for comparing the characteristic voltage with a reference voltage of the reference voltage terminal; and wherein the timing controller is further connected to the gate driver; and the timing controller is configured for receiving a comparison result from the comparator, and when the comparison result indicates that the characteristic voltage is greater than or equal to the reference voltage, the timing controller generates a timing control signal such that the first pull-up voltage terminal and the second pull-up voltage terminal are caused to output a DC voltage under the control of the timing control signal, thereby causing the first pull-down node and the second pull-down node to be simultaneously charged, and both the first pull-down circuit and the second pull-down circuit to be in a working state, the method comprising:

collecting a voltage of the first pull-up voltage terminal or the second pull-up voltage terminal and outputting a characteristic voltage that conforms to characteristics of the voltage of the first pull-down circuit or the second pull-down circuit;

comparing the characteristic voltage with a reference voltage of the reference voltage terminal;

generating a timing control signal when the characteristic voltage is greater than or equal to the reference voltage; and causing the first pull-up voltage terminal or the second pull-up voltage terminal to output a DC voltage under the control of the timing control signal, thereby causing the first pull-down node and the second pull-down node to be simultaneously charged, and both the first pull-down circuit and the second pull-down circuit to be in a working state.

12. A display device, comprising a display driving circuit that comprises a characteristic collector, a comparator, a timing controller and a gate driver;

wherein the gate driver comprises at least two cascade shift register units, each of the at least two cascade shift register units comprising a first pull-down circuit connected to a first pull-down node and a second pull-down circuit connected to a second pull-down node; and the gate driver is provided with a first pull-up voltage terminal for charging the first pull-down node and a second pull-up voltage terminal for charging the second pull-down node;

wherein the characteristic collector is connected to a pull-down voltage terminal and a first input terminal of the comparator, and also to the first pull-up voltage terminal or the second pull-up voltage terminal; the characteristic collector is configured for collecting a voltage of the first pull-up voltage terminal or the second pull-up voltage terminal, and for outputting, to the first input terminal of the comparator, a characteristic voltage which conforms to characteristics of the voltage of the first pull-down circuit or the second pull-down circuit;

wherein a second input terminal of the comparator is connected to a reference voltage terminal, and an output terminal of the comparator is connected to the timing controller; and the comparator is configured for comparing the characteristic voltage with a reference voltage of the reference voltage terminal; and wherein the timing controller is further connected to the gate driver; and the timing controller is configured for receiving a comparison result from the comparator, and when the comparison result indicates that the characteristic voltage is greater than or equal to the reference voltage, the timing controller generates a timing control signal such that the first pull-up voltage terminal and the second pull-up voltage terminal are caused to output a DC voltage under the control of the timing control signal, thereby causing the first pull-down node and the second pull-down node to be simultaneously charged, and both the first pull-down circuit and the second pull-down circuit to be in a working state.

13. The display device according to claim 12, wherein the characteristic collector comprises a first collection transistor and a second collection transistor;

a second electrode of the first collection transistor is connected to a first electrode of the second collection transistor; the first electrode of the second collection transistor is connected to the pull-down voltage terminal; and a second electrode of the second collection transistor is connected to the first input terminal of the comparator; and a gate electrode and a first electrode of the first collection transistor are connected to the first pull-up voltage terminal, and a gate electrode of the second collection transistor is connected to the first pull-up voltage terminal, or wherein the characteristic collector comprises a first collection transistor and a second collection transistor;

a second electrode of the first collection transistor is connected to a first electrode of the second collection transistor; the first electrode of the second collection transistor is connected to the pull-down voltage terminal; and a second electrode of the second collection transistor is connected to the first input terminal of the comparator; and a gate electrode and a first electrode of the first collection transistor are connected to the second pull-up voltage terminal, and a gate electrode of the second collection transistor is connected to the second pull-up voltage terminal.

14. The display device according to claim 12, wherein each of the at least two cascade shift register units further comprises a pull-up control circuit, a pull-up circuit, a reset circuit, a first pull-down control circuit and a second pull-down control circuit;

the pull-up control circuit is connected to a signal input terminal and a pull-up node, and configured for outputting a voltage of the signal input terminal to the pull-up node under the control of the signal input terminal;

the pull-up circuit is connected to a first clock signal input terminal, the pull-up node and a signal output terminal, and configured for outputting a signal of the first clock signal input terminal to the signal output terminal under the control of the pull-up node;

the reset circuit is connected to a reset signal terminal, the pull-down voltage terminal, the pull-up node and the signal output terminal, and configured for respectively pulling down a potential of the pull-up node and of the signal output terminal to a potential of the pull-down voltage terminal under the control of the reset signal terminal;

the first pull-down control circuit is connected to the first pull-up voltage terminal, a second clock signal input terminal, the reset signal terminal, the pull-up node, the first pull-down node and the pull-down voltage terminal, and configured for outputting a voltage of the first pull-up voltage terminal to the first pull-down node under the control of the second clock signal input terminal and the reset signal terminal, or for pulling down a potential of the first pull-down node to the potential of the pull-down voltage terminal under the control of the pull-up node;

the second pull-down control circuit is connected to the second pull-up voltage terminal, the second clock signal input terminal, the reset signal terminal, the pull-up node, the second pull-down node and the pull-down voltage terminal, and configured for outputting a voltage of the second pull-up voltage terminal to the second pull-down node under the control of the second clock signal input terminal and the reset signal terminal, or for pulling down a potential of the second pull-down node to the potential of the pull-down voltage terminal under the control of the pull-up node;

the first pull-down circuit is further connected to the pull-up node, the signal output terminal and the pull-down voltage terminal, and configured for respectively pulling down a potential of the pull-up node and of the signal output terminal to the potential of the pull-down voltage terminal under the control of the first pull-down node; and the second pull-down circuit is further connected to the pull-up node, the signal output terminal and the pull-down voltage terminal, and configured for respectively pulling down the potential of the pull-up node and of the signal output terminal to the potential of the pull-down voltage terminal under the control of the second pull-down node.

15. The display device according to claim 14, wherein the pull-up control circuit includes a first transistor, and a gate electrode and a first electrode of the first transistor are connected to the signal input terminal, and a second electrode of the first transistor is connected to the pull-up node.

16. The display device according to claim 14, wherein the pull-up circuit includes a second transistor and a first capacitor;

a gate electrode of the second transistor is connected to the pull-up node, a first electrode of the second transistor is connected to the first clock signal input terminal and a second electrode of the second transistor is connected to the signal output terminal; and a first end of the first capacitor is connected to the pull-up node and a second end of the first capacitor is connected to the signal output terminal.

17. The display device according to claim 14, wherein the reset circuit includes a third transistor and a fourth transistor;

a gate electrode of the third transistor is connected to the reset signal terminal, a first electrode of the third transistor is connected to the pull-down voltage terminal, and a second electrode of the third transistor is connected to the pull-up node; and a gate electrode of the fourth transistor is connected to the reset signal terminal, a first electrode of the fourth transistor is connected to the pull-down voltage terminal, and a second electrode of the fourth transistor is connected to the signal output terminal.

18. The display device according to claim 14, wherein the first pull-down control circuit includes a fifth transistor, a sixth transistor, and a seventh transistor;

a gate electrode of the fifth transistor is connected to the second clock signal input terminal, a first electrode of the fifth transistor is connected to the first pull-up voltage terminal and a second electrode of the fifth transistor is connected to the first pull-down node;

a gate electrode of the sixth transistor is connected to the reset signal terminal, a first electrode of the sixth transistor is connected to the first pull-up voltage terminal and a second electrode of the sixth transistor is connected to the first pull-down node; and a gate electrode of the seventh transistor is connected to the pull-up node, a first electrode of the seventh transistor is connected to the pull-down voltage terminal, and the second electrode of the seventh transistor is connected to the first pull-down node.

19. The display device according to claim 14, wherein the second pull-down control circuit includes an eighth transistor, a ninth transistor, and a tenth transistor;

a gate electrode of the eighth transistor is connected to the reset signal terminal, a first electrode of the eighth transistor is connected to the second pull-up voltage terminal and a second electrode of the eighth transistor is connected to the second pull-down node;

a gate electrode of the ninth transistor is connected to the second clock signal input terminal, a first electrode of the ninth transistor is connected to the second pull-up voltage terminal and a second electrode of the ninth transistor is connected to the second pull-down node; and a gate electrode of the tenth transistor is connected to the pull-up node, a first electrode of the tenth transistor is connected to the pull-down voltage terminal, and a second electrode of the tenth transistor is connected to the second pull-down node.

20. The display device according to claim 14, wherein the first pull-down circuit includes an eleventh transistor and a twelfth transistor;

a gate electrode of the eleventh transistor is connected to the first pull-down node, a first electrode of the eleventh transistor is connected to the pull-down voltage terminal, and a second electrode of the eleventh transistor is connected to the pull-up node; and a gate electrode of the twelfth transistor is connected to the first pull-down node, a first electrode of the twelfth transistor is connected to the pull-down voltage terminal, and a second electrode of the twelfth transistor is connected to the signal output terminal, wherein the second pull-down circuit includes a thirteenth transistor and a fourteenth transistor;

a gate electrode of the thirteenth transistor is connected to the second pull-down node, a first electrode of the thirteenth transistor is connected to the pull-down voltage terminal, and a second electrode of the thirteenth transistor is connected to the pull-up node; and a gate electrode of the fourteenth transistor is connected to the second pull-down node, a first electrode of the fourteenth transistor is connected to the pull-down voltage terminal, and a second electrode of the fourteenth transistor is connected to the signal output terminal.

* * * * *